US009407038B2

(12) United States Patent
Jozwiak et al.

(10) Patent No.: US 9,407,038 B2
(45) Date of Patent: Aug. 2, 2016

(54) ELECTRICAL DISTRIBUTION CENTER

(71) Applicant: DELPHI TECHNOLOGIES, INC., Troy, MI (US)

(72) Inventors: Andrew Joseph Jozwiak, San Antonio, TX (US); Michael F. Lowe, El Paso, TX (US); Daniel S. Eichorn, Rochester Hills, MI (US); Jesus R. Morales, Chihuahua (MX); Erick A. Rodriguez, Chihuahua (MX); Eduardo Nunez, El Paso, TX (US)

(73) Assignee: Delphi Techologies, Inc., Troy, MI (US)

( * ) Notice: Subject to any disclaimer, the term of this patent is extended or adjusted under 35 U.S.C. 154(b) by 0 days.

(21) Appl. No.: 14/426,796

(22) PCT Filed: Sep. 5, 2013

(86) PCT No.: PCT/US2013/058185

§ 371 (c)(1),
(2) Date: Mar. 9, 2015

(87) PCT Pub. No.: WO2014/046877

PCT Pub. Date: Mar. 27, 2014

(65) Prior Publication Data

US 2015/0288099 A1 Oct. 8, 2015

Related U.S. Application Data

(60) Provisional application No. 61/702,334, filed on Sep. 18, 2012.

(51) Int. Cl.
*H01R 13/62* (2006.01)
*H01R 13/629* (2006.01)

(52) U.S. Cl.
CPC .... *H01R 13/62961* (2013.01); *H01R 13/62977* (2013.01); *H01R 13/62922* (2013.01); *H01R 2201/26* (2013.01)

(58) Field of Classification Search
CPC ..... H01R 13/62938; H01R 13/639
USPC ..... 439/157, 347, 489, 752, 595, 701
See application file for complete search history.

(56) References Cited

U.S. PATENT DOCUMENTS

| | | | | |
|---|---|---|---|---|
| 6,019,620 | A | 2/2000 | Kodama et al. | |
| 6,065,982 | A | 5/2000 | Okabe | |
| 6,305,957 | B1 * | 10/2001 | Fink | H01R 13/62977 439/157 |
| 6,824,406 | B1 | 11/2004 | Sharples et al. | |
| 7,094,081 | B1 | 8/2006 | Senk, Jr. et al. | |
| 7,445,491 | B2 | 11/2008 | Fukii et al. | |

OTHER PUBLICATIONS

International Search Report dated Feb. 7, 2014.

* cited by examiner

*Primary Examiner* — Phuongchi T Nguyen
(74) *Attorney, Agent, or Firm* — Robert J Myers

(57) ABSTRACT

An electrical distribution center having a base connected to one or several wiring harnesses and a connector body that is configured to be electrically and mechanically connected to the base. The connector body houses electrical devices such as relays, fuses, and control modules. The connector body is secured to the base by a pair of slides having dog-leg shaped slots that engage studs on the base. A single slide lever having two arms attached to each of the slides is pivotably attached to the connector body and the slides and is configured to simultaneously move the dog-leg shaped slots relative to the studs on the base, thereby securing the connector body to the base.

7 Claims, 5 Drawing Sheets

ELECTRICAL DISTRIBUTION CENTER

TECHNICAL FIELD OF THE INVENTION

The invention generally relates to electrical distribution center that may be configured for use in a vehicle, and more particularly relates to an electrical distribution center having a plurality of slides and a single lever configured to secure a connector body to a base.

BACKGROUND OF THE INVENTION

Electrical connector assemblies, such as a simple electrical connector or a multi-functional electrical distribution center, are widely used. The electrical distribution centers are generally a central junction box or block system designed as a stand-alone assembly. The electrical connectors typically electrically connect at least two wire harnesses together and thus house a plurality of connected male and female terminals. The distribution centers perform a similar function as the electrical connectors, but may also house various fuses, relays and other electrical devices in a central location. Electrical distribution centers not only reduce cost by consolidating various functions and/or electrical connections into one block, but the centers also reduce the number of cut and spliced leads which increases reliability. Such electrical distribution centers include provisions for electrically connecting a power source and electrical devices housed in the junction block to electrical wiring harness connectors for supplying power and control signals to various electrical systems.

In many electrical distribution center applications, such as that used in the engine compartment of a vehicle, disclosed in U.S. Pat. No. 5,715,135, to Brussalis, the entire disclosure of which is hereby incorporated by reference, devices such as fuses and relays of the electrical distribution centers are accessible from the top with bases protruding from a bottom side. Unfortunately, due to this orientation, access to the connectors is often difficult for mating (connecting) and unmating (disconnecting). In many cases, the electrical distribution center has to be flipped upside down, the connectors assembled, and the entire assembly with protruding wire harnesses flipped again into a final position.

Known electrical distribution centers, such as that disclosed in Brussalis, typically mount the fuses, relays and electrical devices to a top side of an upper electrical distribution panel. A plurality of double ended terminals is engaged to and extends through a tray located below the panel. A top end of each terminal projects through a respective slot of the upper panel for engagement to the fuse, relay or electrical device. A bottom end of the male terminal projects downward through respective slots of yet a second lower tray for electrical engagement to terminals locked into at least one electrical connector body which is engaged to a lower support structure of the distribution center. Unfortunately, the panel, trays and connector bodies are all held together by a plurality of threaded fasteners which is costly to manufacture and requires special tools for assembly and maintenance purposes.

Known improvements to this conventional distribution assembly are described in U.S. Pat. No. 5,788,529 to Borzi issued 4 Aug. 1988, U.S. Pat. No. 6,739,889, to Daggett, issued 25 May 2004, and U.S. Pat. No. 7,094,081 to Senk, et al. issued 22 Aug. 2006. In Borzi and Daggett, the distribution assembly is not flipped when assembling internal connectors and does not require the use of threaded fasteners or bolts thus does not need special assembly tools to secure various connector bodies of the distribution assembly together. Instead, an engagement mechanism or leverage device having four independent cam levers applies a normal force when the cam levers are rotated to connect the distribution assembly. Simultaneous rotation of the four levers also produces a moment which is countered by various structural and alignment features incorporated into this known distribution assembly to maintain alignment of the terminals during connecting. In Senk, the engagement mechanism has two independent cam levers that apply a normal force when rotated to connect the distribution assembly.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

The inventors recognized the problems created by the prior art electrical distribution centers of requiring packaging space to be allocated on both ends of the electrical distribution center for the levers. The inventors also recognized that separate levers on each end of the electrical distribution center restricts where the electrical distribution center can be mounted in the vehicle while meeting ergonomic requirements to operate the levers. The inventors further recognized the potential for misalignment between the connectors or the connector bodies of the electrical distribution center caused when the levers are engaged separately from each other.

Described herein are solutions for an electrical distribution center having a single lever configured to apply a normal force when rotated to connect the electrical distribution center. The single lever is located centrally in the electrical distribution center. The single lever does not require packaging space to be allocated on both ends to accommodate movement of the lever. Because the electrical distribution center has a single lever, the likelihood of misalignment caused by engaging a plurality of levers separately is reduced. The single lever may also be mounted to the electrical distribution center either laterally or longitudinally, providing greater flexibility for mounting locations in the vehicle that can meet ergonomic requirements.

In accordance with one embodiment of this invention, an electrical distribution center configured for use in a motor vehicle is provided. The electrical distribution center includes a connector body, a base, a first and second slide, and a slide lever. The connector body has a first side wall spaced apart from a second side wall and an electrically conductive first terminal that is rigidly engaged to the connector body. The base has an electrically conductive second terminal rigidly engaged to the base. The second terminal is constructed and arranged to electrically connect with the first terminal. The base defines a first stud and a second stud that are constructed and arranged to mechanically connect with the connector body. The base further includes an electrical connector that is configured be attached to a mating connector of a wire harness. The first slide is slideably supported within a first channel that is defined by the first side wall. The first slide is spaced inwardly from the first side wall and defines a first dog-leg shaped slot configured to engage the first stud. The a second slide slideably supported within a second channel defined by the second side wall and spaced inwardly from the second side wall and defining a second dog-leg shaped slot configured to engage the second stud. The slide lever is pivotally connected to the first and second side walls of the connector body, the first slide, and the second slide. The slide lever has a first arm connected by a handle to a second arm that is spaced apart from the first arm. The first arm extends between the first slide and the first side wall and the second arm extending between the second slide and the second side wall. The slide lever is operable to simultaneously slideably move the first and second dog-leg shaped slots with respect to the first and second stud, thereby connecting the connector body with the base.

The base may include a plurality of first studs and a plurality of second studs. The first slide may include a plurality of first slots and the second slide may include a plurality of second slots.

The connector body may define a rectangular shape that has a major axis and a minor axis. The first and second slides may be disposed substantially parallel to the major axis or the minor axis.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

The electrical distribution center described herein utilizes a single lever to make the connection in the vehicle from the wire harness electrical connectors to the electrical distribution center. It has a single slide lever that drives a pair of slides which engage studs on the base thereby pulling the electrical center downward onto the electrical connectors. This configuration allows the electrical center to be mounted in one of multiple orientations while still maintaining ergonomic requirements for operating the lever.

Figure 1:
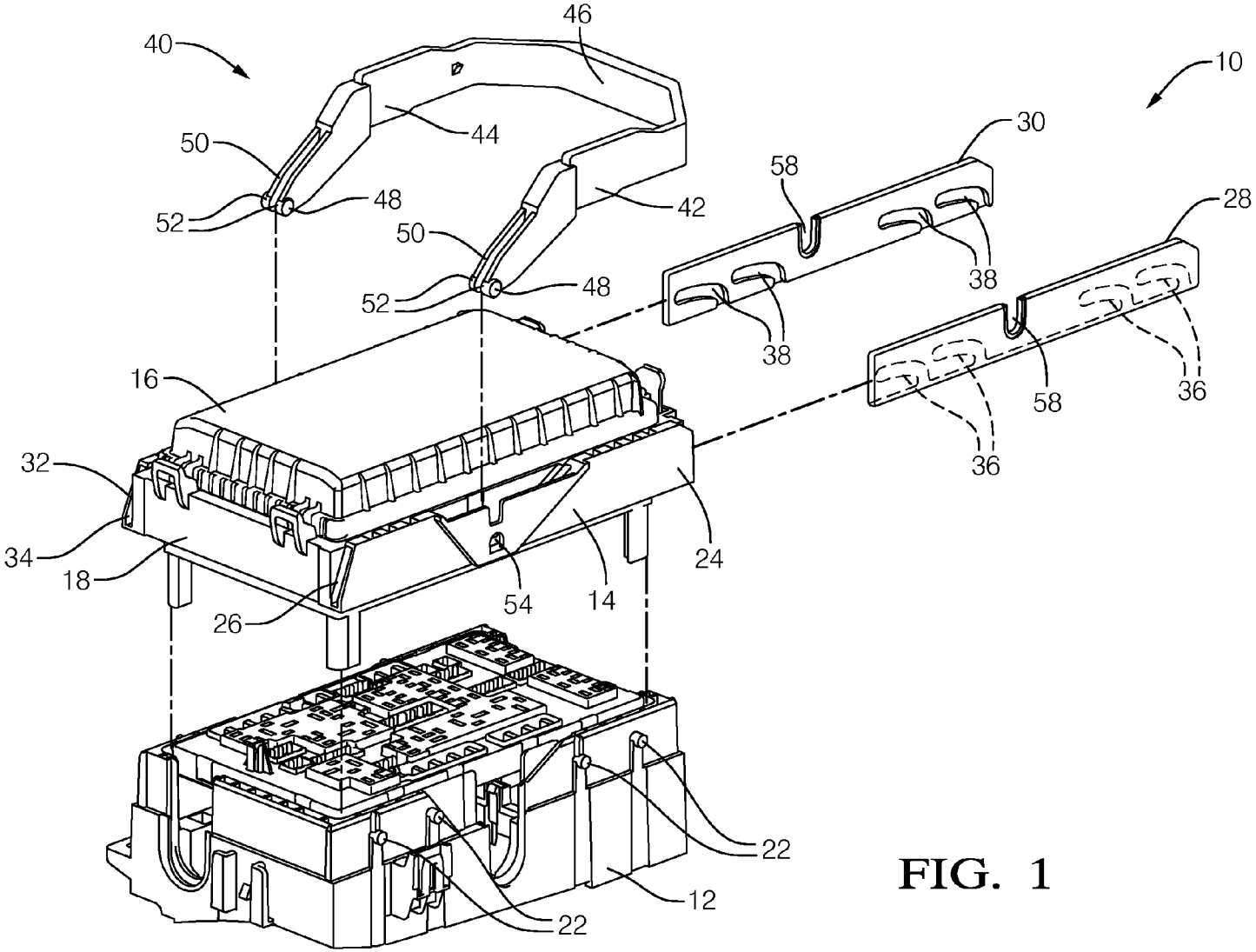
FIG. 1 is an exploded perspective view of an electrical distribution center in accordance with one embodiment.

Referring to the various figures wherein like numerals refer to like elements throughout the several views, the exploded assembly view of FIG. 1 illustrates a non-limiting example of an electrical distribution center 10. The electrical distribution center 10 includes a base 12, a connector body 14, and a cover 16 attached to the connector body 14. The cover 16 is configured for covering and protecting relays, fuses, and control modules (not shown) within the connector body 14. The cover 16 attaches to the connector body 14 by means of several locking tangs 18 that lock the cover 16 to the connector body 14.

The base 12 includes an electrical connector (not shown) that is configured be attached to a mating connector (not shown) of a wire harness (not shown). The electrical connector also includes electrical terminals (not shown) that are configured to engage electrical terminals (not shown) included in the connector body 14. The base 12 defines an unthreaded first stud 22 and a corresponding unthreaded second stud on the opposite side of the base 12 (not shown due to the perspective of the drawing). Each stud 22 may be characterized as a boss or cylindrical protuberance extending from the sides of the base 12. The base 12 may define a plurality of first studs 22 and a plurality of second studs. The connector body 14 is configured to connect with the base 12, thus establishing electrical connection between the electrical terminals in the connector body 14 and the electrical terminals in the base 12.

The connector body 14 includes a first side wall 24 spaced apart from the connector body 14 and defining a first channel 26 between the connector body 14 and the first side wall 24. A first slide 28 is inserted into the first channel 26 and is slidably supported in the first channel 26 and is spaced inwardly from the first side wall 24. The connector body 14 also includes a second slide 30 that is similarly slidably supported in a second channel 32 defined between a second side wall 34 and the connector body 14 on the opposite side of the connector body 14 from the first side wall 24. The second slide 30 is spaced inwardly from the second side wall 34. The first and second channels 26, 32 are molded as part of the connector body 14. The first and second channels 26, 32 support the first and second slides 28, 30 respectively, but in a position spaced away from the first and second side walls 24, 34 respectively of the connector body 14.

The first slide 28 includes a first dog-legged shaped connecting slot 36 that is adapted to receive the first stud 22 of the base 12. The second slide 30 also includes a second dog-legged shaped connecting slot 38 that is adapted to receive the second stud of the base 12. A slide lever 40 is pivotally interconnected with the connector body 14 and each of the first and second slides 28, 30, and is operable to move the first and second slides 28, 30, with respect to the connector body 14 to facilitate connecting the connector body 14 with the base 12.

The slide lever 40 has a first arm 42 and a spaced apart second arm 44 attached to a central handle portion 46 that is configured to be gripped by an operator. The free ends 48 of the first and second arm 42, 44, that is the ends not attached to the central handle portion 46, define a forked shape having an arm slot 50 between the tines of the fork shape. The first and second slides 28, 30 are disposed in the arm slots 50 of the first and second arms 42, 44 respectively. The free ends 48 of the first arm 42 and the second arm 44 each defines a pair of pivot pins 52 that pivotally engage an opening 54 in the first and second side walls 24, 34 and an opening in the side of the connector body (not shown). The pivot pins 52 and the openings in the connector body 14 allow the slide lever 40 to pivot in relation to the connector body 14. Each pivot pin 52 may be substantially equidistant from each end of each side wall 24, 34. As used herein, substantially equidistant means±10 millimeters of absolutely equidistant.

Figure 2:
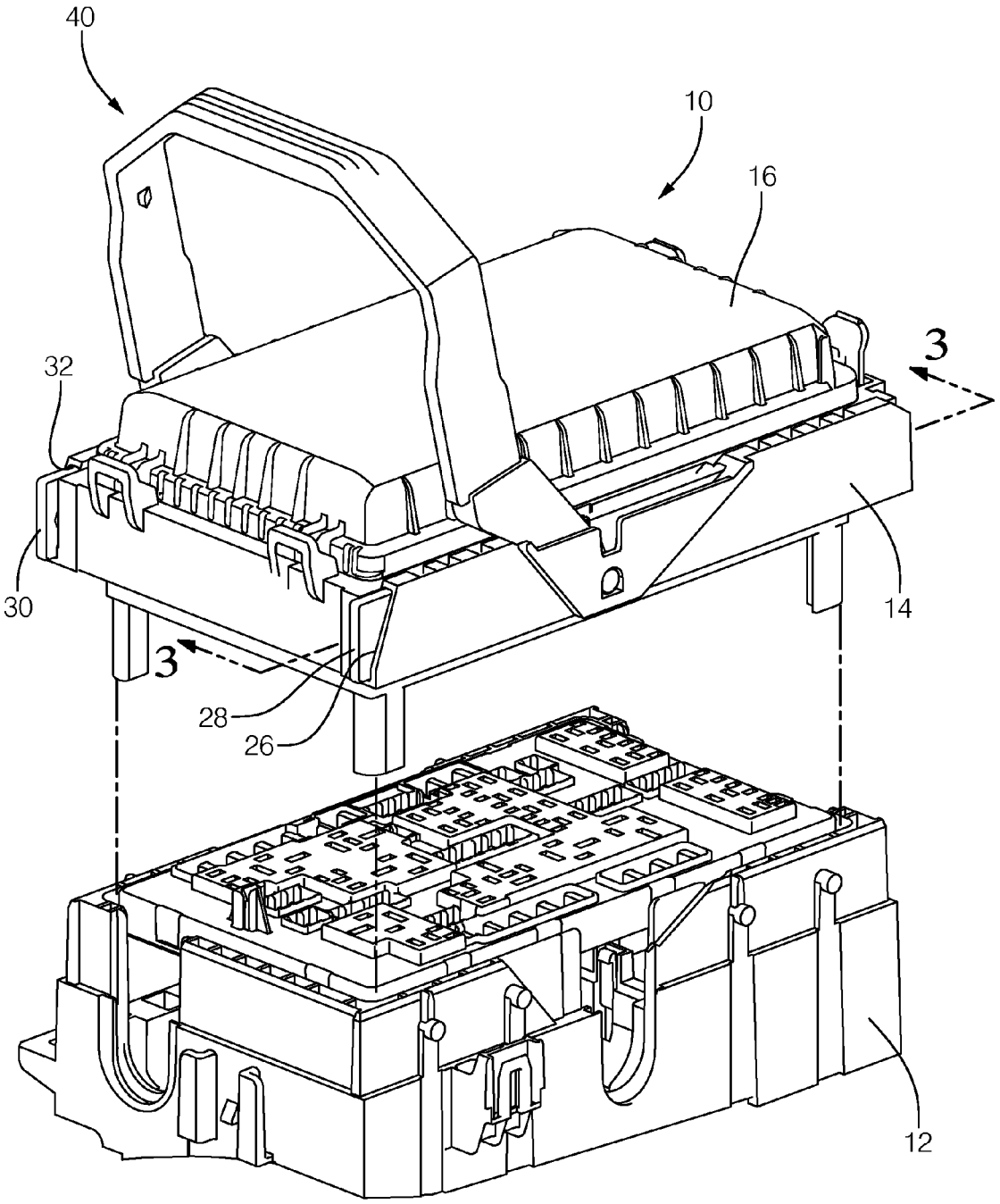
FIG. 2 is a perspective view of a connector body the electrical distribution center of FIG. 1 disconnected from a base in accordance with one embodiment.

FIG. 2 illustrates the electrical distribution center 10 in an assembled condition with the slide lever 40 in the open position. With the slide lever 40 in the open position, a portion of the first and second slides 28, 30 protrude from the first and second channels 26, 32.

Figure 3:
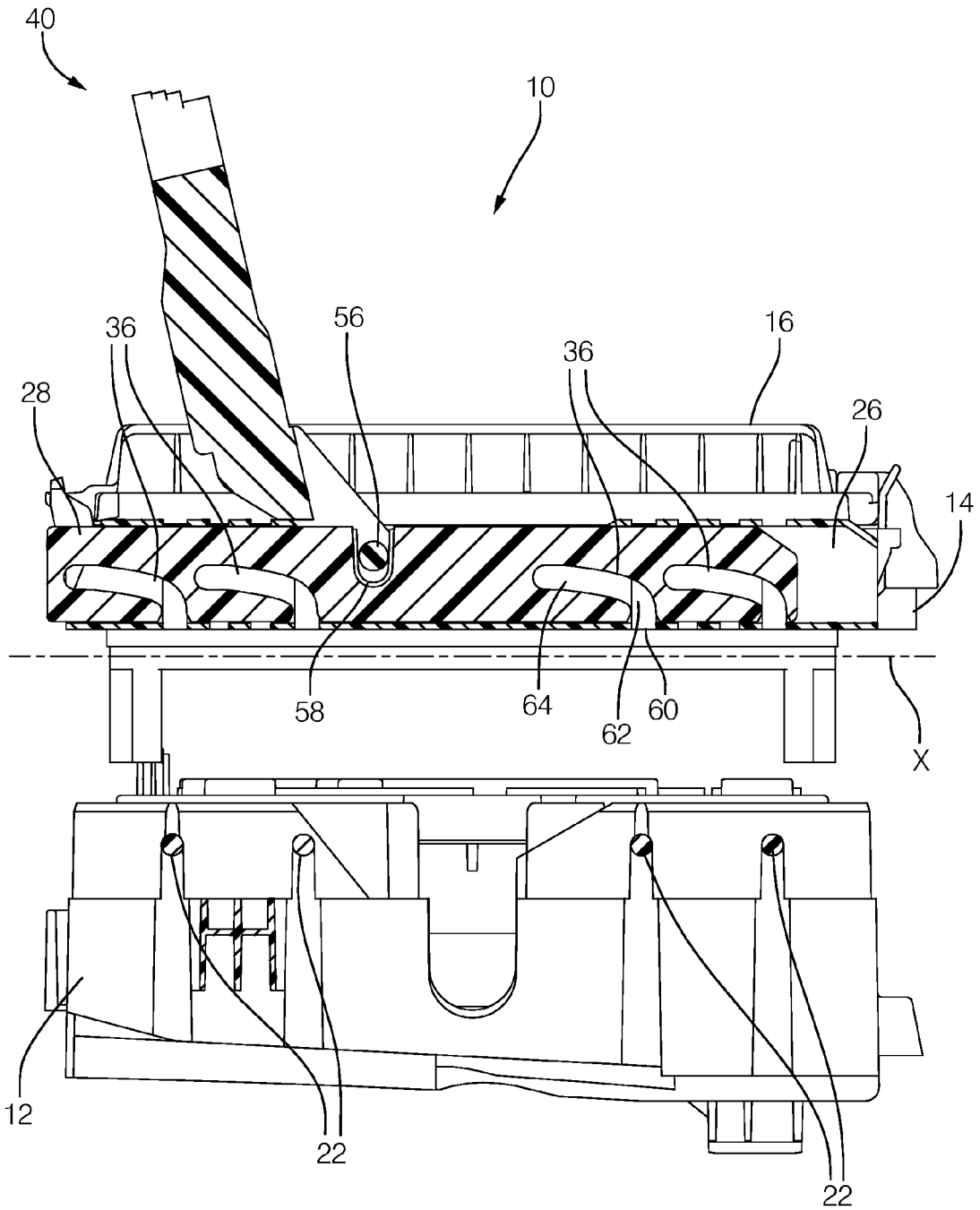
FIG. 3 is a partial cut-away side view of the electrical distribution center shown in FIG. 2 in accordance with one embodiment.

FIG. 3 illustrates a partial cutaway view of the electrical distribution center 10 as illustrated in FIG. 2 wherein the first side wall 24 and the outside tine of the first arm 42 are removed. As shown in FIG. 3, the first arm 42 defines a slide pin 56. The slide pin 56 has a tapered surface to facilitate engagement with the first slide 28 during assembly. The first slide 28 defines U-shaped slide pin slot 58 that is sized to receive the heads of the pivot pins 52. Without subscribing to any particular theory of operation, the slide pin 56 interfaces with the slide pin slot 58 so that as the lever pivots about the pivot pin, the slide pin 56 pushes the first slide 28 longitudinally, that is along the longitudinal axis X, within the first channel 26. The second arm 44 likewise defines a similar slide pin that interfaces with a similar U-shaped slide pin slot to push the second slide 30 longitudinally within the second channel 32. The slide lever 40 and first and second slides 28, 30 are configured so that the first and second slides 28, 30 move substantially simultaneously within the first and second channels 26, 32. As used herein, substantially simultaneously means that the first and second slides begin and end movement within 250 milliseconds of each other and the movement of one slide is within ±5 millimeters of the other. As can be best seen in FIG. 3, the first connecting slot 36 defines a dog-leg shape that has an open end 60 or mouth that is configured to allow entry of the first stud 22 into the first connecting slot 36 when the connector body 14 is mated to the base 12. The first connecting slot 36 defines a "knee" 62 whereat the slot curves to a closed end 64 wherein the first stud 22 is retained when the first slide 28 is moved by the slide lever 40 to the locked position. The axis of the closed end 64 of the slot defines an angle relative to the open end 60 of the slot that is generally greater than 90 degrees and preferably about 106 degrees.

Figure 4:
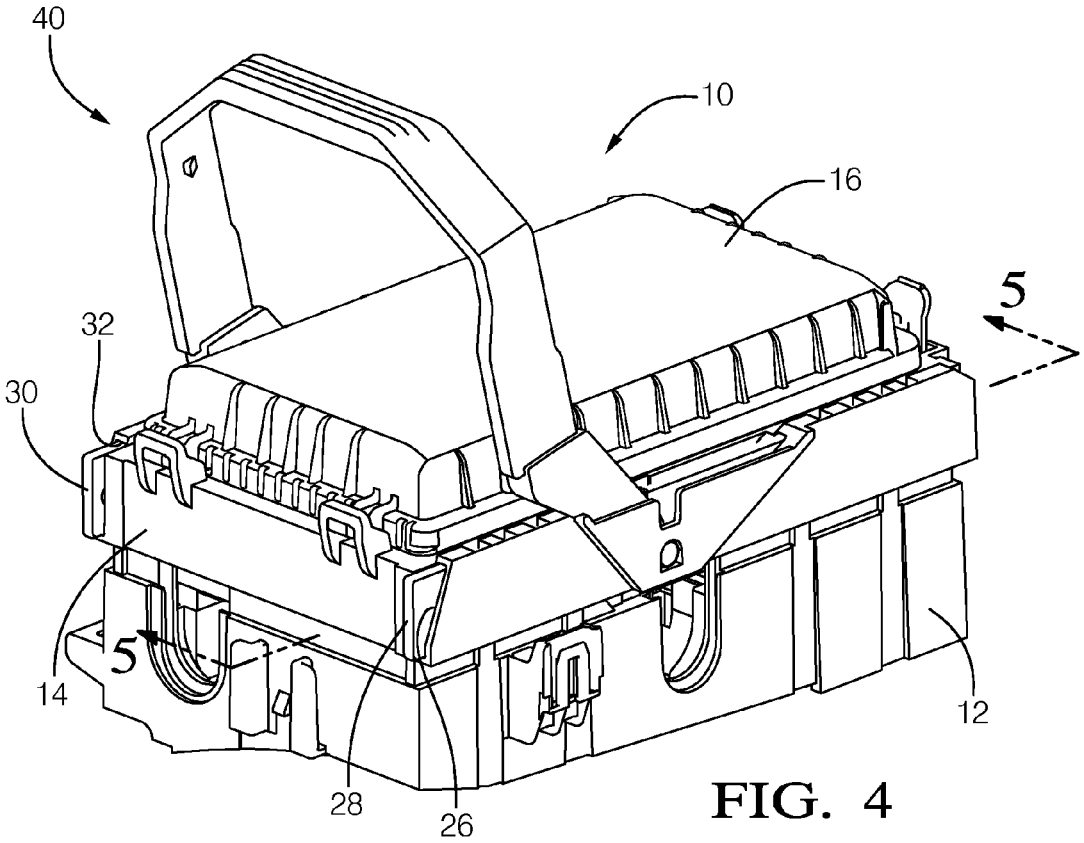
FIG. 4 is a perspective view of the connector body the electrical distribution center of FIG. 1 connected to the base with a slide lever in an open position in accordance with one embodiment.

FIG. 4 illustrates an example of the electrical distribution center 10 wherein the connector body 14 is placed on the base 12 and the slide lever 40 is in the open position.

Figure 5:
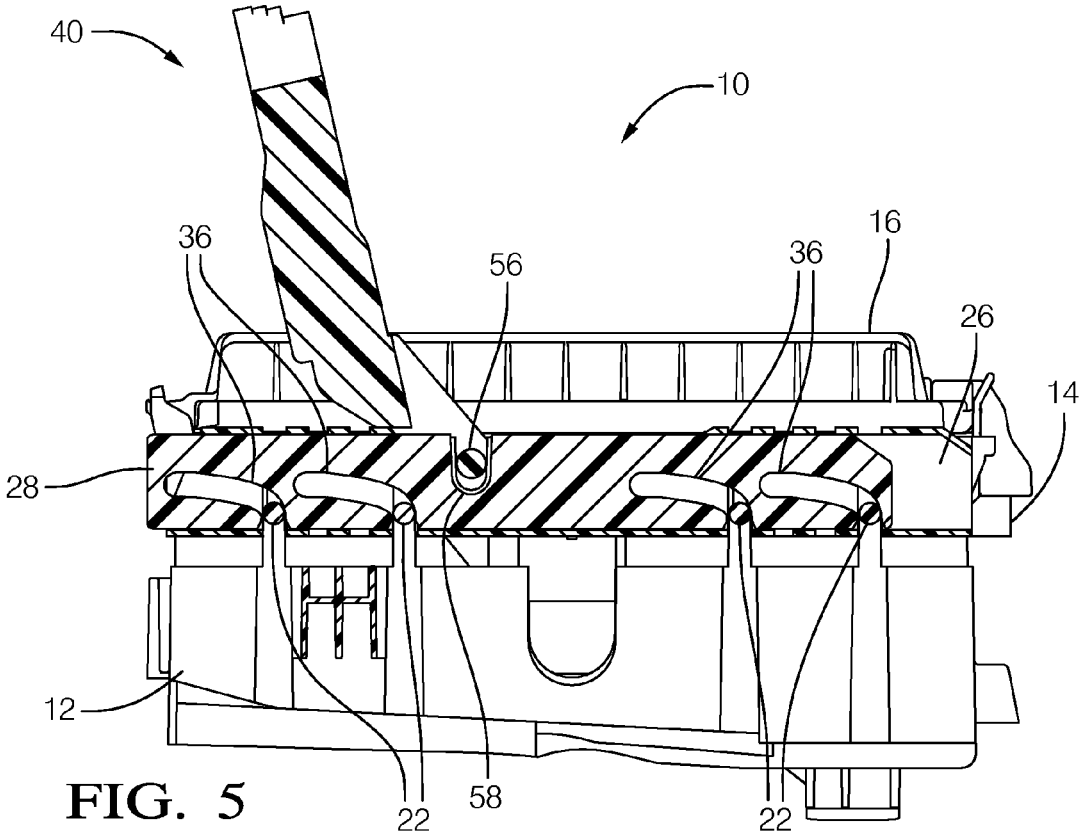
FIG. 5 is a partial cut-away side view of the electrical distribution center shown in FIG. 4 in accordance with one embodiment.

FIG. 5 illustrates a partial cutaway view of the electrical distribution center 10 as illustrated in FIG. 4 wherein the first side wall 24 and the outside tine of the first arm 42 are removed. As shown in FIG. 5, each of the first studs 22 is at a beginning point in the open end 60 of each of the first connecting slots 36. As the first slide 28 moves, it draws the first stud 22 from a beginning point at the mouth of the slot to an ending point at or near the opposite end of the first connecting slot 36. This action, which is essentially a camming action, draws the base 12 tighter against the connector body 14 and retains it in this tight relationship.

Figure 6:
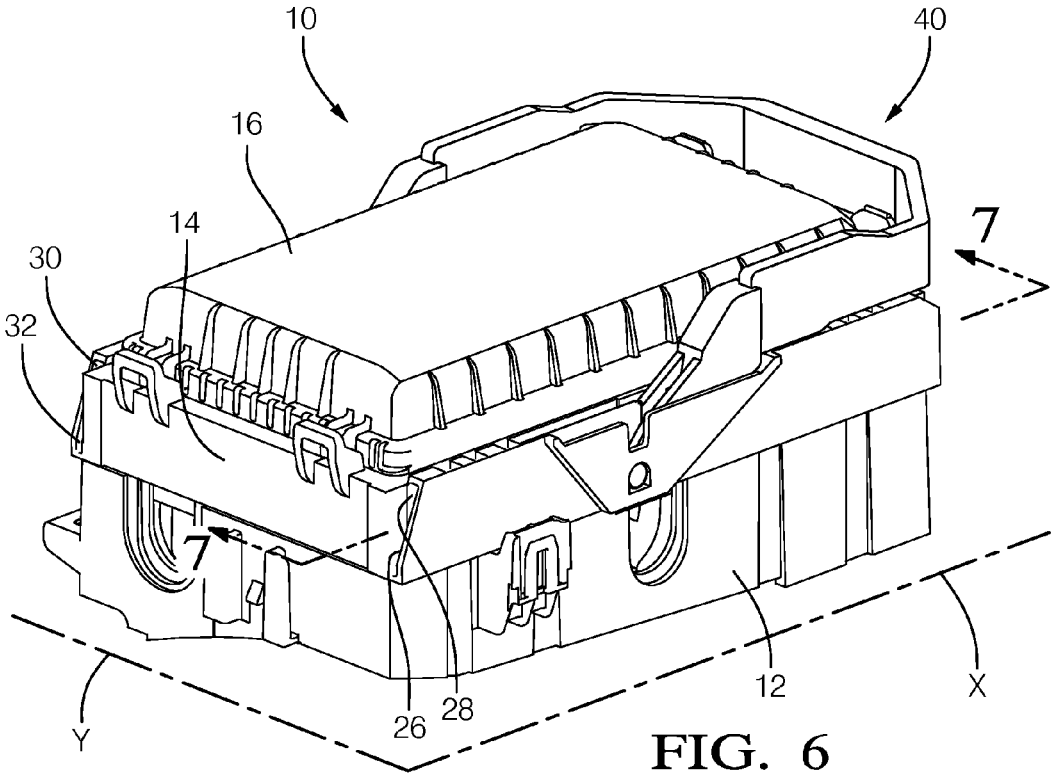
FIG. 6 is a perspective view of the connector body the electrical distribution center of FIG. 1 connected to the base with a slide lever in a locked position in accordance with one embodiment.

FIG. 6 illustrates an example of the electrical distribution center 10 wherein the slide lever 40 is in a closed position and the connector body 14 is tightly secured to the base 12. As shown the non-limiting example of FIG. 6, the slide lever 40 has moved the first and second slides 28, 30 so that they no longer protrude from the first and second channels 26, 32.

Figure 7:
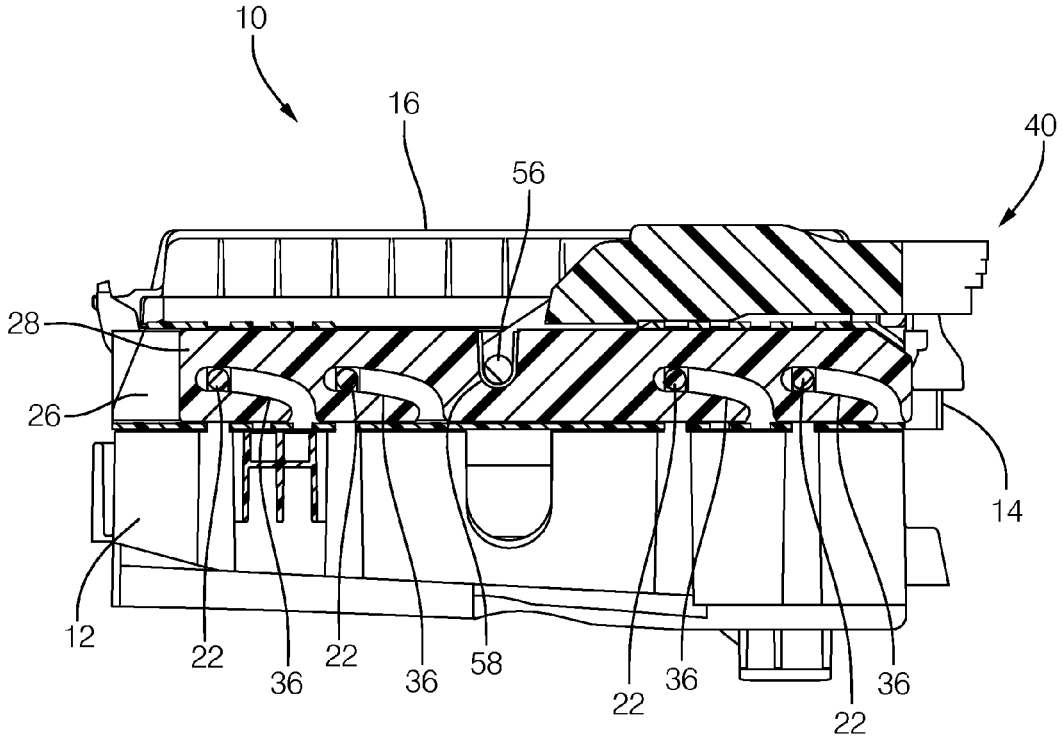
FIG. 7 is a partial cut-away side view of the electrical distribution center shown in FIG. 6 in accordance with one embodiment.

FIG. 7 illustrates a partial cutaway view of the electrical distribution center 10 as illustrated in FIG. 5 wherein the first side wall 24 and the outside tine of the first arm 42 are removed. As shown in FIG. 7, each of the first studs 22 is at an ending point in the closed end 64 of each of the first connecting slots 36 after the slide lever 40 has moved the first slide 28 relative to the first studs 22.

The second slide 30, second stud, and second arm 44 contain all of the features of the first slide 28, first stud 22, and first arm 42 illustrated in FIGS. 3, 5, and 7. The second slide 30 functions similarly and substantially simultaneously with the first slide 28.

The first and second arms 42, 44 each terminate in a tip segment. The first and second arms 42, 44 each include an abutment disposed adjacent the tip segment, wherein the abutment extends outwardly from the tip segment relative to an imaginary axis running the length of each arm. In other words, the tip segment is narrower than the portion of the arm having the abutment.

Each channel defines a support slot that is sized to provide clearance to the tip segment, but not the abutment, so that the tip segment passes through the support slot until the abutment abuts the channel. The support slot may be viewed as an interruption in the channel.

The connector body 14 defines a deflection slot adjacent the support slot. The deflection slot is contiguous with the support slot. The purpose of the deflection slot is to allow the side walls of the connector body 14 to deflect outwardly when the slide lever 40 is connected to the first and second slides 28, 30 during assembly.

The electrical distribution center 10 may define a rectangular shape having a major axis and a minor axis. The first and second slides 28, 30 may be disposed substantially parallel to the major axis X (longitudinally) or alternatively may be disposed substantially parallel to the minor axis Y (laterally). As used herein, substantially parallel is ±15° of absolutely parallel. Thus, being able to mount the slides laterally or longitudinally may provide greater flexibility for finding mounting locations in the vehicle for the electrical distribution center 10 that can meet ergonomic requirements for an operator operating the slide lever 40.

The component pieces of the electrical distribution center 10 including the connector body 14, base 12, first and second slides 28, 30, and slide lever 40 are made from a suitable injection molded plastic, such as polyamide (PA, NYLON), polybutylene terephthalate (PBT), or polypropylene (PP).

Accordingly, an electrical distribution center 10 is provided. The connector body 14 may be attached to the base 12 of the electrical distribution center 10 by operating a single slide lever 40. The single slide lever 40 does not require packaging space to be allocated on both ends of the electrical distribution center 10 to accommodate movement of the slide lever 40. Because the electrical distribution center 10 has a single slide lever 40, the likelihood of misalignment caused by engaging a plurality of levers separately is reduced. The single slide lever 40 may also be mounted to the electrical distribution center 10 either laterally or longitudinally, providing greater flexibility for mounting locations in the vehicle that can meet ergonomic requirements.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical apparatus configured for use in a motor vehicle, comprising:

a connector body having a first side wall spaced apart from a second side wall and an electrically conductive first terminal rigidly engaged to the connector body;

a base having an electrically conductive second terminal rigidly engaged to the base and constructed and arranged to electrically connect with the first terminal defining a first stud and a second stud constructed and arranged to mechanically connect with the connector body, said base further including an electrical connector configured be attached to a mating connector of a wire harness;

a first slide slideably supported within a first channel defined by the first side wall and spaced inwardly from the first side wall, the first slide defining a first dog-leg shaped slot configured to engage the first stud;

a second slide slideably supported within a second channel defined by the second side wall and spaced inwardly from the second side wall, the second slide defining a second dog-leg shaped slot configured to engage the second stud; and a slide lever pivotally connected to the connector body, the first slide, and the second slide, the slide lever having a first arm connected by a handle to a second arm spaced apart from the first arm, wherein the first arm defines a fork shape having a first arm slot and the second arm defines a fork shape having a second arm slot, wherein the first slide is disposed within the first arm slot and the second slide is disposed within the second arm slot, and wherein the slide lever is operable to simultaneously slideably move the first and second dog-leg shaped slots with respect to the first and second stud, thereby connecting the connector body with the base.

2. The apparatus according to claim 1, wherein the first arm is pivotally connected to a central portion of the first side wall and the second arm is pivotally connected to a central portion of the second side wall.

3. The apparatus according to claim 2, wherein the connector body defines a rectangular shape having a major axis and a minor axis and wherein the first and second slides are disposed substantially parallel to the major axis.

4. The apparatus according to claim 2, wherein the connector body defines a rectangular shape having a major axis-and a minor axis and wherein the first and second slides are disposed substantially parallel to the minor axis.

5. The apparatus according to claim 2, wherein an open end of the first dog-leg shaped slot defines about a 74 degree angle with a closed end of the first dog-leg shaped slot.

6. The apparatus according to claim 2, wherein the connector body includes a first pivot pin extending from the first side wall and engaging the first arm and a second pivot pin extending from the second side wall and engaging the second arm.

7. The apparatus according to claim 6, wherein each pivot pin is substantially equidistant from each end of each side wall.

* * * * *